United States Patent [19]

Wittmann et al.

[11] Patent Number: 5,027,710

[45] Date of Patent: Jul. 2, 1991

[54] PRACTICE PROJECTILE WITHOUT AN EXPLOSIVE FOR FIRING AGAINST A PRACTICE TARGET WITH LARGE-CALIBERED WEAPONS

[75] Inventors: Jurgen Wittmann, Nuremberg; Wolfgang Mosig, Hartmannshop; Erich Bock, Nuremberg, all of Fed. Rep. of Germany

[73] Assignee: Diehl GmbH & Co., Nuremberg, Fed. Rep. of Germany

[21] Appl. No.: 588,187

[22] Filed: Sep. 26, 1990

[30] Foreign Application Priority Data

Oct. 7, 1989 [DE] Fed. Rep. of Germany ..... 3933534

[51] Int. Cl.[5] ..... F42B 12/38; F42B 8/00

[52] U.S. Cl. ..... 102/513; 102/517; 102/529; 102/498

[58] Field of Search ..... 102/439, 444, 501, 498, 102/513, 517, 529

[56] References Cited

U.S. PATENT DOCUMENTS 1,825,517 9/1931 Cardner .
3,019,733 2/1962 Braid .

FOREIGN PATENT DOCUMENTS 2639884 9/1976 Fed. Rep. of Germany .
2641021 3/1978 Fed. Rep. of Germany ..... 102/529
6009469 9/1981 Fed. Rep. of Germany .
3335970 10/1983 Fed. Rep. of Germany .
8513427 5/1985 Fed. Rep. of Germany .
2115118 9/1983 United Kingdom ..... 102/529

OTHER PUBLICATIONS

Rheinmetall, Waffentechnisches Taschenbuch 1973, pp. 125 through 141, 160, 162.
German Office Action.

*Primary Examiner*—Harold J. Tudor
*Attorney, Agent, or Firm*—Scully, Scott, Murphy & Presser

[57] ABSTRACT

A practice projectile without an explosive for firing against a practice target with large-calibered weapons, wherein the projectile incorporates a projectile body which is in the configuration of a cylinder and which possesses a conical nose cone. The projectile includes a nose cone which is constructed in the shape of a truncated cone having a flat leading end surface with a diameter of about 0.08 to 0.1 that of the projectile caliber, wherein the nose cone forms a sharp contact edge with the cylinder of the projectile; a ratio in the length of the nose cone to that of the cylinder of approximately 1:1±5%; a location of the center of gravity of 3 to 3.5 times the projectile caliber, measured commencing from the leading end surface; and a ratio of 4.0 to 7.0 for the moments of inertia between the transverse and longitudinal moments.

6 Claims, 1 Drawing Sheet

PRACTICE PROJECTILE WITHOUT AN EXPLOSIVE FOR FIRING AGAINST A PRACTICE TARGET WITH LARGE-CALIBERED WEAPONS

BACKGROUND OF THE INVENTION

1. Field of the Invention

The present invention relates to a practice projectile without an explosive for firing against a practice target with large-calibered weapons, wherein the projectile incorporates a projectile body which is in the configuration of a cylinder and which possesses a conical nose cone.

2. Discussion of the Prior Art

From the disclosure of U.S. Pat. No. 1,825,517 there has become known a practice projectile which, independently of the wall thickness of a cylindrical section thereof, maintains the same center of gravity for its mass. This practice projectile is provided with a full caliber, and with respect to its external configuration and its weight corresponds to a live projectile.

The firing against practice targets with full-calibered practice projectiles is extremely expensive. Hereby, this necessitates the employment of projectiles with properties or characteristics which conform with the internal and external ballistics of the live projectiles. Furthermore, a cost factor which must also be taken into consideration is the wear encountered by the weapon barrel.

Somewhat more economical is the firing with the aid of an insert tube system in which a small-calibered firing apparatus is installed in the existent large-calibered weapon system.

For example, for a projectile caliber of 120 mm there is employed a firing apparatus possessing a caliber of 35 mm. By means of this relatively small-sized practice projectile there should then be enabled the simulation of the firing or delivery attitude and external ballistics of a large-calibered, heavy hollow-charge projectile of the spike type, which flies under an extremely intense air resistance or drag up to about a distance of 2500 m to the target. Achieved thereby is that during practice firing, the gun crew handling the weapon, artillery piece or ordnance can make use of the firing tables for the full-calibered battle or live ammunition.

In the above-mentioned U.S. patent, this technical problem is not addressed, inasmuch as the foregoing relates to a practice projectile which in its design and constructional data conforms to a live projectile.

From the disclosure of U.S. Pat. No. 3,019,733 there has additionally become known a practice projectile whose caliber also corresponds with the caliber of a live projectile and the other applicable data thereof and which, as a consequence, evidences the same external ballistics.

The nose cone is primarily conically configured and equipped with a rounded off tip. The transition of the nose cone into a cylinder is arcuate or curvilinear; in effect, it is stepless. The cylinder possesses a guide ring and a crimping for a shell or cartridge casing. The cylinder closes off with a radius. The problem which is to be solved by the invention is similarly not addressed, inasmuch as the external shape of the practice projectile is constructed so as to provide a low flow resistance or drag, in essence, to be aerodynamically expedient, and consequently is not suited for a simulation of the above-mentioned hollow-charge projectile.

SUMMARY OF THE INVENTION

Accordingly, it is an object of the present invention to contemplate the provision of a practice projectile with a specified fall-off in its velocity. The trajectory of the projectile and the firing distance to a target of about 2500 m should correspond with that of a substantially larger projectile.

The invention attains the foregoing object through the provision of a practice projectile of the type as described herein, in that the projectile includes the combination of the following features:

a) a nose cone which is constructed in the shape of a truncated cone having a flat leading end surface with a diameter of about 0.08 to 0.1 that of the projectile caliber, wherein the nose cone forms a sharp contact edge with the cylinder of the projectile;

b) a ratio in the length of the nose cone to that of the cylinder of approximately 1:1±5%;

c) a location of the center of gravity of 3 to 3.5 times the projectile caliber, measured commencing from from the leading end surface; and d) a ratio of 4.0 to 7.0 for the moments of inertia between the transverse and longitudinal moments.

Surprisingly attained through the intermediary of the invention is that the practice projectile possesses simple geometric configurations and can thus be inexpensively manufactured. The manufacturing tolerances which are encountered do not exert any measurable influence over the firing characteristics of the projectile, its trajectory and its target striking picture.

It is also important that for the first time, in accordance with the invention, there is obtained a projectile which is smaller in its caliber, which simulates a relatively slow-flying shot with a relatively high fall-off in velocity corresponding to that of a large-calibered hollow-charge projectile of the spike type.

BRIEF DESCRIPTION OF THE DRAWINGS

Reference may now be had to the following detailed description of exemplary embodiments of practice projectiles constructed pursuant to the invention, taken in conjunction with the accompanying drawings; in which.

DETAILED DESCRIPTION

Figure 1:
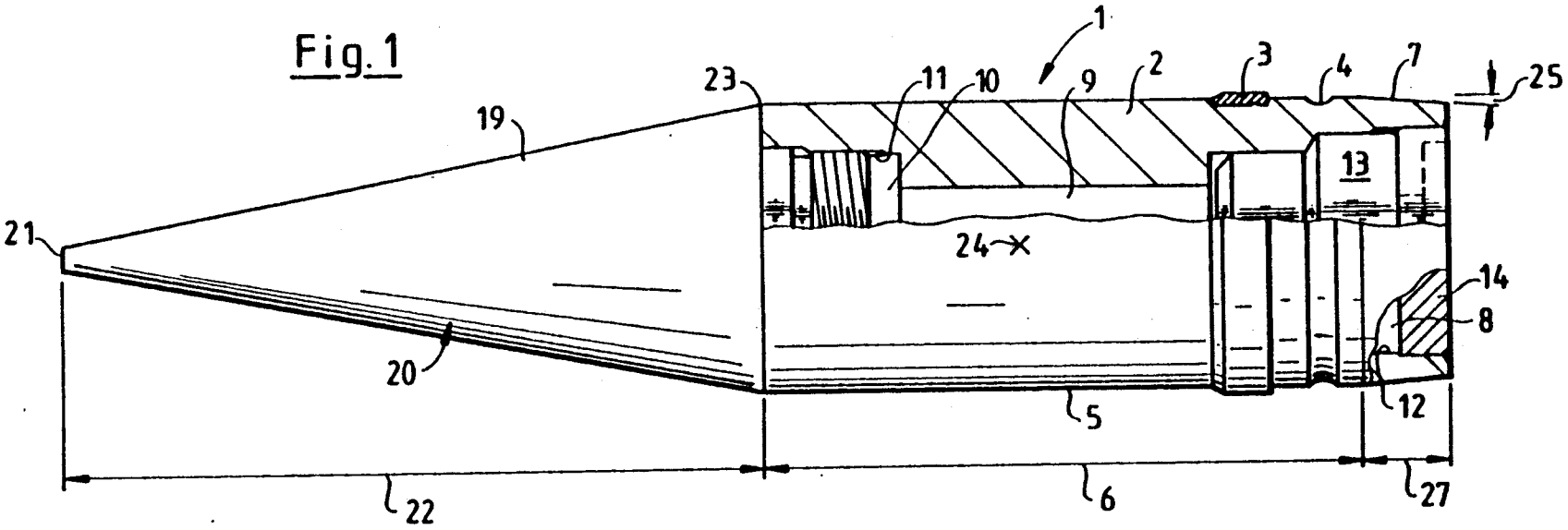
FIG. 1 illustrates a longitudinal view, partly in section, of a first embodiment of a practice projectile constructed pursuant to the invention.

In accordance with FIG. 1 of the drawings, a practice projectile 1 consists of a hollow body 2 constituted from steel, incorporating a usual guide band 3, a crimping groove 4, an outer cylinder 5 according to one section 6, a conical tail end portion 7, and recesses 8 through 10 each provided with screwthreads 11, 12.

A usual luminescent tracer-insert or charge 13 is arranged in the recess 8. Instead of this insert 13, there can also be screwed in a solid base plate 14 which consists of steel.

A nose cone 20, which is constructed in the shape of a truncated cone 19 and is constituted from an aluminum alloy, has an end surface 21 and of a length 22, is screwed together with the screwthread 11, and together with the cylinder 5, forms a contact edge 23. The center of gravity for the projectile and an angle at the tail end portion thereof are identified by, respectively, reference numerals 24, 25. The tail end portion 7 has an axial length 27.

For a 35 mm-caliber practice projectile employed for the simulation of a reference projectile (not shown) representing a 120 mm/105 mm-caliber hollow-charge projectile of the spike type, there are present the following values:

| | |
|---|---|
| End surface 21 (diameter) | 0.086 caliber |
| Length 22 | 4.9 caliber |
| Length 6 | 4.7 caliber |
| Lengths 22:6 | 1:0.96 |
| Ratio of Moments of Inertia Transverse/Longitudinal | 6.54 |
| Distance of the Center of Gravity of the Projectile 22 from the Leading End Surface | 3.3 caliber |
| Length 27 | 0.3 caliber |
| Angle 25 | 4° |
| Total Mass | 0.55 kg |

Definition of the term "Caliber"

The concept of "Caliber" relates to the projectile diameter; in effect, caliber 35 mm corresponds to a projectile diameter of 35 mm.

Figure 2:
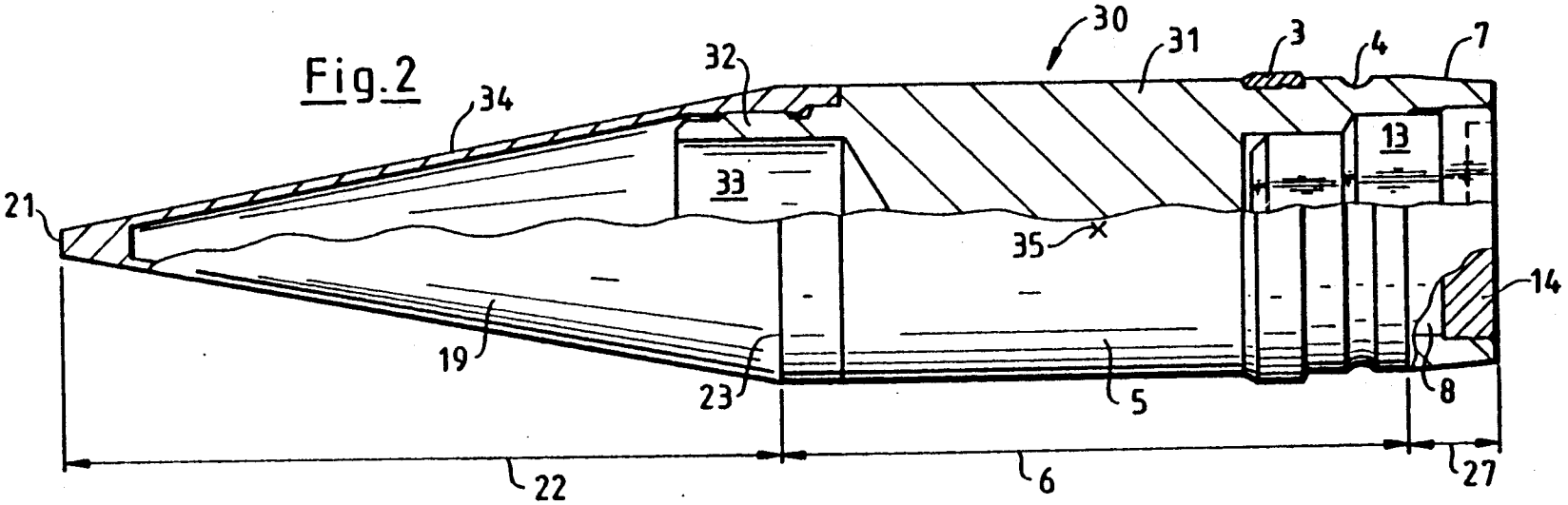
FIG. 2 illustrates in a view similar to that of FIG. 1, an embodiment of a second practice projectile.

In accordance with the embodiment of FIG. 2, distinguishing from the embodiment of the practice projectile 1, a practice projectile 30 consists of a solid body 31 constituted from steel, including a hollow thin-walled threaded trunnion or extension 32 possessing a bore 33, and a thin-walled hood 34 constituted from an aluminum alloy. The location of the center of gravity is identified by reference numeral 35. At a construction with a caliber of 35 mm, there are present the following values which deviate from that of the practice projectile 1:

| | |
|---|---|
| Ratio of Moments of Inertia Transverse/Longitudinal | 4.3 |
| Distance of the Center of Gravity 35 from the Leading End Surface 31 | 3.48 caliber. |

The remaining values are the same as in FIG. 1.

Both practice projectiles 1,30 conform to the firing characteristics and the trajectory of the mentioned reference projectiles and do not exceed the permissible standard deviation for the target picture up to a distance of 2000 m.

Of significance to the air-resistance or drag characteristics is the shape of the truncated cone 19.

A specified flow separation for the practice projectiles 1,30 is provided by means of the leading end surface 21. Hereby, any aerodynamic disturbances or turbulences, such as the angle of incidence, exert only a slight effect.

The practice projectiles 1,30 are also particularly stable in flight due to the external shapes thereof, in the configuration of a truncated cone 19 and cylinder 15.

The drop-off in the velocity or speed for the projectile is predicated on the coefficient of drag or the air resistance produced through the external shape of the practice projectile 1,30. In this connection, particularly significant are the leading end surface 21, the truncated cone 19, the contact edge 23 and the cylinder 5.

What is claimed is:

1. Practice projectile without an explosive for firing against a target with large-calibered weapons, including a cylindrical projectile body and a conical nose cone; comprising in combination:

a) a nose cone configured as a truncated cone having a flat leading end surface with a diameter of about 0.082 to 0.1 the projectile caliber, said nose cone forming a contact edge with the cylindrical body of the projectile;

b) the length of the nose cone relative to the length of the cylindrical body being in a ratio of approximately 1:1±5%;

c) the position of the center of gravity of the projectile being about 3 to 3.5 times the projectile caliber measured from the leading end surface; and d) the moments of inertia between the transverse and longitudinal moments being in a ratio of about 4.0 to 7.0.

2. Practice projectile as claimed in claim 1, wherein said cylindrical body includes a conical tail end portion having a length of about 0.3 caliber and an angle of about 2 to 6°.

3. Practice projectile as claimed in claim 1, wherein the nose cone is constituted from a solid material consisting of an aluminum alloy, and the projectile body consists of a hollow member constituted from steel and having recesses formed therein.

4. Practice projectile as claimed in claim 3, wherein the hollow body is closed off by a base plate at the tail end thereof.

5. Practice projectile as claimed in claim 3, wherein the hollow body has a luminescent tracer-insert arranged therein.

6. Practice projectile as claimed in claim 1, wherein said nose cone is constituted from a thin walled hood consisting of an aluminum alloy or steel, and is screwed onto a hollow threaded trunnion of a solid projectile body constituted from steel, a recess being formed in the tail end of said solid body for the receipt of a base plate or for a luminescent tracer-insert.

* * * * *